United States Patent [19]

Lazcano-Navarro et al.

[11] Patent Number: 4,894,122

[45] Date of Patent: Jan. 16, 1990

[54] CONTINUOUS PROCESS FOR THE DESULPHURIZATION OF CARBONACEOUS RESIDUALS FROM DISTILLATION OF PETROLEUM USING A PLURALITY OF FLUIDIZED BEDS

[75] Inventors: Arturo Lazcano-Navarro, Monclova; Andres Geronimo-Torres, Saltillo, both of Mexico

[73] Assignee: Instituto Mexicano de Investigaciones Siderurgicas, Saltillo, Mexico

[21] Appl. No.: 297,524

[22] Filed: Jan. 17, 1989

Related U.S. Application Data

[63] Continuation-in-part of Ser. No. 64,808, Jun. 22, 1987, abandoned.

[51] Int. Cl.[4] ..... C01B 31/02

[52] U.S. Cl. ..... 201/17; 201/19; 201/31; 201/36; 201/44; 423/461

[58] Field of Search ..... 201/17, 19, 31, 36, 201/43, 44; 423/448, 449, 461, DIG. 16

[56] References Cited

U.S. PATENT DOCUMENTS

| | | | |
|---|---|---|---|
| 2,983,673 | 5/1961 | Grove | 208/153 |
| 3,086,923 | 4/1963 | Destremps et al. | 201/17 |
| 3,284,317 | 11/1966 | Jahnig et al. | 201/17 |
| 3,929,585 | 12/1975 | Grimmett | 201/31 |
| 4,160,813 | 7/1979 | Markel et al. | 423/448 |
| 4,359,451 | 11/1982 | Tipton | 201/17 |

*Primary Examiner*—Joye L. Woodard

*Attorney, Agent, or Firm*—Laurence R. Brown; Alfred J. Mangels

[57] ABSTRACT

A process for the desulphurization of residuals of petroleum distillation in the form of coke particles having an initial sulphur content greater than about 5% by weight. Desulphurization is effected by means of a continuous electrothermal process based on a plurality of sequentially connected fluidized beds into which the coke particles are successively introduced. The necessary heat generation to desulphurize the coke particles is obtained by using the coke particles as an electrical resistance in each fluidized bed by providing a pair of electrodes that extend into the fluidized coke particles and passing an electrical current through the electrodes and through the fluidized coke particles. A last fluidized bed without electrodes is provided for cooling the desulphurized coke particles after the sulphur level has been reduced to less than about 1% by weight.

3 Claims, 1 Drawing Sheet

CONTINUOUS PROCESS FOR THE DESULPHURIZATION OF CARBONACEOUS RESIDUALS FROM DISTILLATION OF PETROLEUM USING A PLURALITY OF FLUIDIZED BEDS

CROSS-REFERENCE TO RELATED APPLICATION

This application is a continuation-in-part of copending application Ser. No. 07/064,808, filed June 22, 1987, now abandoned.

BACKGROUND OF THE INVENTION

1. Field of the Invention

This invention relates to a process for the desulphurization of carbonaceous materials, and more particularly to a process for the desulphurization of petroleum coke having a sulphur content of over about 5% by weight, to provide a final coke product having a sulphur content of less than about 1% by weight. Desulphurization of the coke is accomplished by heating coke particles sequentially in a plurality of individual, spaced fluidized beds that are connected by inclined ducts, so that the petroleum coke particles pass from one fluidized bed to a succeeding bed through the inclined ducts.

2. Description of the Related Art

Heating of petroleum coke particles to desulphurize the particles can be effected in several ways, including the passing of an electric current through a fluidized bed of the particles. Because such particles can conduct electric current, the amount depending upon their electrical resistivity, such a heating technique is the most efficient way to directly heat the particles. Moreover, electrical heating can provide high particle temperatures of over 3000° C., and even as high as the temperature at which graphite sublimates (approximately 3700° C.).

The electrical resistivity of petroleum coke particles varies over a wide range, from thousands of ohm-cm. for undevolatilized petroleum coke having over about 5% sulphur content by weight, to about $1\times10^{-3}$ ohm-cm. for graphite that is obtained from petroleum coke. Devolatilized petroleum coke that contains over about 5% sulphur by weight has an electrical resistivity of approximately 10 ohm-cm. Low sulphur petroleum coke having a sulphur content of about 0.3% by weight, which can be obtained by desulphurizing petroleum coke having an initial sulphur content over 5% by weight, has an electrical resistivity of approximately 0.10 ohm-cm. Hence, the electrical resistivity of devolatilized but undesulphurized petroleum coke is on the order of about one hundred times higher than the electrical resistivity of desulphurized petroleum coke having a sulphur content of about 0.3% by weight. Further, desulphurized petroleum coke is partially graphitized.

If a high sulphur petroleum coke is to be continuously desulphurized by means of electrical heating in a single fluidized bed, as is suggested in U.S. Pat. No. 4,160,813, which issued July 10, 1979, to Markel et al., and if the coke particles are to act as an electrical resistance, it is necessary to have an electrical power system capable of providing a wide range of voltages and/or currents. The higher sulphur content particles entering the single fluidized bed have a higher electrical resistance, and when they are added to the partially desulphurized particles in the bed they sharply increase the electrical resistance of the totality of petroleum coke particles in the fluidized bed. Moreover, the electrical power delivered to heat the particles must be sufficient to permit the particles to reach a desulphurization temperature greater than about 1700° C. to obtain a sulphur content less than 0.5% by weight in the fluidized bed.

A disadvantage when using a single fluidized bed for the continuous desulphurization of petroleum coke is that the residence times of the particles can vary considerably, and the sulphur content of the particles at the output of the fluidized bed is therefore less uniform. Additionally, when using a single bed for the continuous treatment of high sulphur petroleum coke, the fluidized bed temperature must be high (greater than about 1800° C.), because the entering particles reach the temperature of the fluidized bed in seconds (in some cases the entering particles are preheated up to 1000° C.), and the resulting desulphurized petroleum coke is adversely affected in that the porosity of the particles increases and the mechanical strength of the particles decreases. Furthermore, even if several zones in a single vessel are separated by partitions, as is suggested in U.S. Pat. No. 2,983,673, which issued May 9, 1961, to Grove, and each separate zone is independently heated, because of heat transfer between the zones it is very difficult to maintain different temperatures in each zone.

SUMMARY OF THE INVENTION

The present invention overcomes the problems noted above by utilizing a plurality of separate fluidized beds that are interconnected in a series, wherein each fluidized bed except the last one, which is a cooling bed, contains particles that lie in a narrow, predetermined range of electrical resistance, and that have a corresponding narrow range of sulphur content, starting with the highest sulfur content particles in the first fluidized bed with particles having decreasing sulfur contents in the subsequent fluidized beds. The temperature of the particles in the first fluidized bed is the lowest of the particle temperatures in the heated beds, and the particle temperatures are maintained at successively higher levels in the other successive fluidized beds. Specifically, the temperature of the particles in the first fluidized bed is maintained at between about 1300° C. and about 1600° C., and the temperature of the particles in the last of the heated fluidized beds is maintained at a temperature greater than about 1900° C. The temperatures of the particles in the other fluidized beds are between that of the first fluidized bed and that of the last of the heated fluidized beds.

Each of the heated fluidized beds is divided by a vertical wall opposite the particulate material inlet, so that the particles of petroleum coke are deflected and must pass under the vertical wall before they pass into the electrical heating zone, which is located downstream of the vertical wall. The reason for avoiding the immediate entrance of the particles to the electrical heating zone is because the particles already within the fluidized bed have a lower sulphur content and a higher temperature than that of the entering particles, and the latter are preferably added on a gradual basis. The vertical wall also prevents the entering particles of petroleum coke from passing directly through a fluidized bed to the next fluidized bed.

In a zone between the particle inlet and the vertical wall in the first fluidized bed, the entering undevolatilized particles reach approximately 1000° C. and as a consequence they are substantially devolatilized.

The fluidization of the petroleum coke particles in each of the fluidized beds, including the cooling bed, is effected by introducing gas upwardly through the bottom of each bed. The gas can be nitrogen, argon, carbon monoxide, hydrogen, reformed natural gas, or mixtures thereof.

The coke particles in the several fluidized beds range in size from about −20 to about +80 mesh, and the fluidized beds are consecutively interconnected by inclined ducts, so that the particles of petroleum coke slide, due to the effects of gravity, from one fluidized bed to the next one.

DESCRIPTION OF THE PREFERRED EMBODIMENTS

Figure 3:
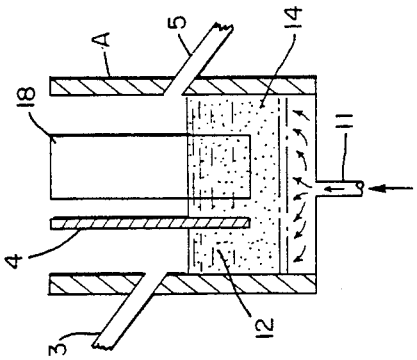
FIG. 3 is a longitudinal cross-sectional view through a heated fluidized bed, taken along the line 3—3 of FIG. 2.

The process disclosed herein is described based upon the physical and chemical characteristics of petroleum coke that is obtained from the distillation of Mayan petroleum having a sulphur content of approximately 7% by weight, and it is based on the apparatus illustrated in the drawing figures. However, it will be appreciated by those skilled in the art that the description based upon Mayan petroleum is merely illustrative, and the process can be practiced using coke made from petroleum obtained from other sources.

Figure 1:
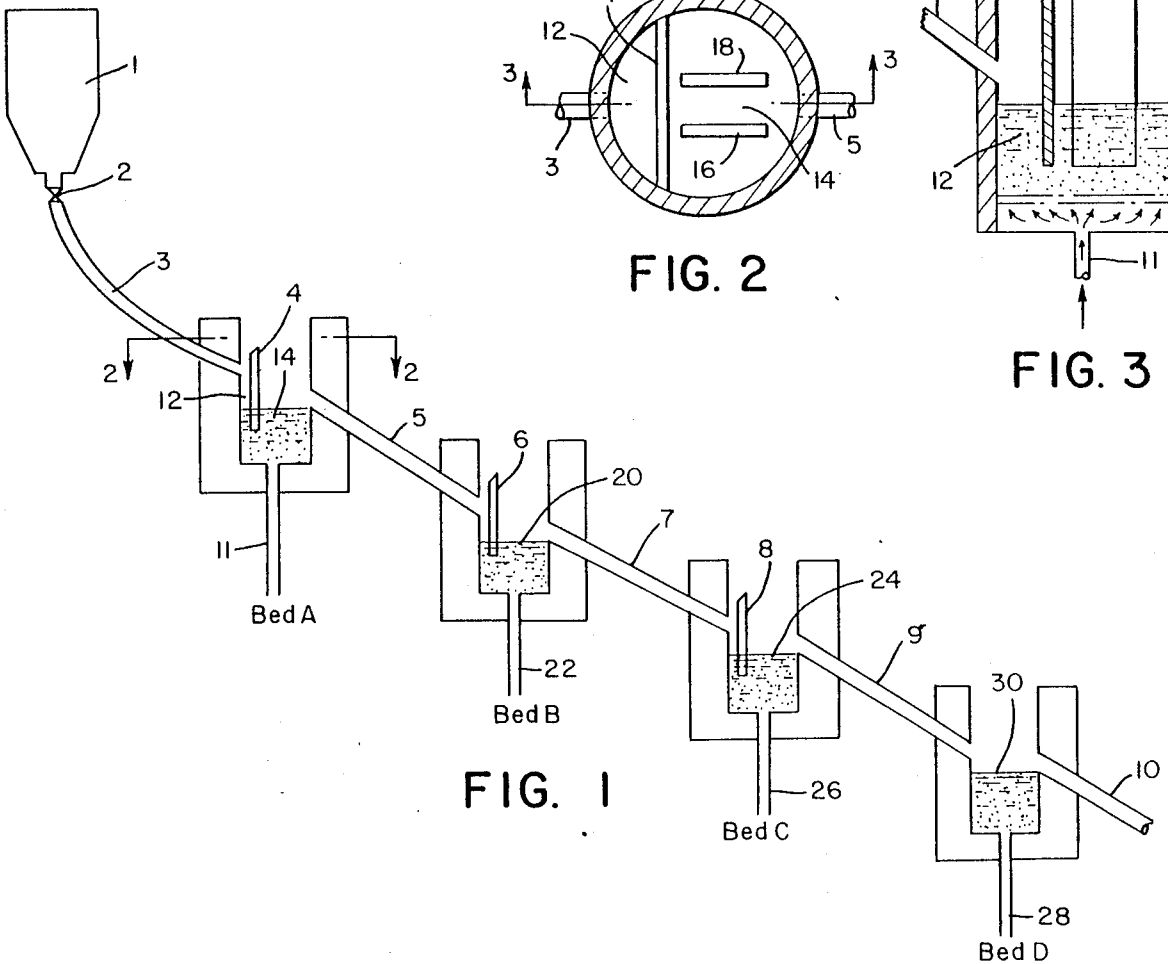
FIG. 1 is a diagrammatic view showing one form of apparatus that can be used to carry out the process that is the subject of the present invention.

Referring now to the drawing, and particularly to FIG. 1 thereof, particles of undevolatilized petroleum coke having a size of from about −20 to about +80 mesh and having a sulphur content of approximately 7% by weight flow by gravity from a loading hopper 1 through a flow control valve 2, that controls the feeding rate of the particles of petroleum coke, and through a duct 3 to provide a continuous flow of particles of petroleum coke to a first fluidized bed A. Beds A, B and C, which each have a capacity of about 15 kg of coke particles, are vertically spaced from each other so that the particles progress from the first bed at the highest elevation to each successive bed at a successively lower elevation to permit gravity flow of the particles from one bed to a succeeding bed. For example, the vertical separation between corresponding portions of successive beds can be about 50 cm.

Upon startup of the process, and before undevolatilized coke particles enter bed A from hopper 1, coke particles are added to each of the beds and are fluidized. The initial coke particles in each of the beds are of a particular particle size and sulphur level in order to permit the process to properly start. The particle sizes of the initial particles in each heated bed range from about −20 to about +80 mesh. In bed A the initial particles have a sulphur content of between about 3% and about 4% by weight and they are heated to a temperature of between about 1500° C. and about 1600° C.; in bed B the initial particles have a sulphur content of between about 1.2% and about 1.8% sulphur by weight and they are heated to a temperature of between about 1650° C. and about 1700° C.; and in bed C the initial particles have a sulphur content of between about 0.5% and about 0.9% by weight and they are heated to a temperature of between about 1950° C. and about 2200° C. The heating of the initial particles in each bed is accomplished by passing an electrical current between two electrodes that extend into the fluidized particles in each bed, to heat the particles in the respective heated beds to the initial temperatures specified above, and the heating of the particles is effected within the respective beds in substantially the same manner as is hereinafter described in the context of steady-state operation of the process.

In fluidized bed A the sulphur content of the petroleum coke particles is reduced from about 7% by weight to between about 3% to about 4% by weight by maintaining the temperature in fluidized bed A between about 1500° C. and about 1600° C. in a manner to be hereinafter described. The fluidization of the particles is effected by introducing gaseous nitrogen upwardly into the bottom of the bed A, through conduit 11 (also shown in FIG. 3).

Figure 2:
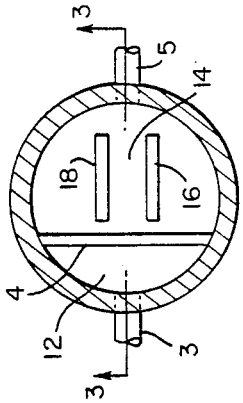
FIG. 2 is a transverse cross-sectional view through a heated fluidized bed, taken along the line 2—2 of FIG. 1.

In order to avoid the possibility of particles of undevolatilized petroleum coke passing directly through bed A and immediately into bed B, a vertical wall 4 is placed in bed A just downstream of inlet conduit 3 to deflect the petroleum coke particles downwardly toward the bottom of bed A. In zone 12 (see also FIGS. 2 and 3), between inlet conduit 3 and vertical wall 4, the undevolatilized particles are heated by thermal conduction to a temperature of approximately 1000° C. and they are thereby devolatilized. Vertical wall 4 prevents the petroleum coke particles from passing directly into the electrical heating zone 14, because to get to that zone the particles first have to pass under the lower edge of the vertical wall.

The heating of the particles in zone 14 is carried out by passing an electrical current through those particles of petroleum coke between two graphite electrodes 16, 18 (see FIGS. 2 and 3) that are spaced from each other by a predetermined distance (which can be approximately 7.5 cm for a 15 kg capacity bed) for the control of the electric current and therefore of the electrical power supplied. Preferably, the graphite electrodes have water cooled copper connectors (not shown). The residence time of the coke particles in fluidized bed A is between about 0.5 and 1 hour, and after that time the particles have a sulphur content of from about 3% to about 4% by weight.

Referring once again to FIG. 1, the particles of petroleum coke leave fluidized bed A through conduit 5 to fluidized bed B and they are deflected downwardly by the vertical wall 6 in bed B, as was the case with wall 4 in bed A, to avoid direct passage of the particles from bed B to bed C, and to cause the particles to more gradually enter the electric heating zone 20 in bed B. Thus, to get to the electric heating zone 20, the particles have to pass under vertical wall 6. The temperature in fluidized bed B is maintained between about 1650° C. and about 1700° C., and fluidization of the coke particles is effected by introducing gaseous nitrogen upwardly through conduit 22 that extends through the bottom of bed B. In fluidized bed B, the sulphur content of the coke particles is reduced to between about 1.2% and about 1.8% by weight. As was the case in bed A, heating of the coke particles in bed B is carried out by passing an electric current through the particles of petroleum coke between two graphite electrodes separated by a predetermined distance for the control of the electric current and therefore of the electric power supplied. The graphite electrodes preferably have water cooled copper connectors (not shown) and the use of nitrogen as the fluidizing gas avoids oxidation of the graphite electrodes. The residence time of the particles of petroleum coke in fluidized bed B is between about 0.5 and about 1 hour.

The particles of petroleum coke pass from bed B to bed C through conduit 7 and are diverted by vertical wall 8 in bed C to avoid their direct passage through bed C and into cooling bed D, and also to more gradually introduce the particles into electric heating zone 24, as was the case in beds A and B. In fluidized bed C the sulphur content of the particles is reduced to a level of between about 0.9% and about 0.5% by weight. The temperature in bed C is maintained between about 1950° C. and about 2200° C., and fluidization of the coke particles is effected by introducing gaseous nitrogen upwardly through conduit 26 into the bottom of bed C. The heating of the particles is carried out by passing an electric current through the fluidized particles of petroleum coke in heating zone 24 between two graphite electrodes that are separated by a predetermined distance for the control of the electric current and therefore of the electric power supplied. The graphite electrodes have water cooled copper connectors (not shown), and the use of nitrogen as the fluidizing gas avoids oxidation of the graphite electrodes. The residence time of the particles of petroleum coke in fluidized bed C is between about 0.5 and about 1 hour, and the sulphur content of the particles in bed C is reduced to between about 0.9% to about 0.5% by weight.

The particles pass from bed C through conduit 9 to fluidized bed D, which is not heated and which serves as a cooling bed for fluidizing and cooling the particles with nitrogen gas that is introduced through conduit 28 into the bottom of bed D to provide a particle cooling zone 30. The residence time of the particles of petroleum coke in fluidized bed D is between about 0.25 and about 0.5 hour.

After cooling, the particles of petroleum coke pass through conduit 10 into a hopper (not shown) for storage. The total time for the particles to travel from conduit 3 at the entrance to bed A to conduit 10 at the outlet of bed D is between about 2.5 hours to about 3.5 hours.

Below are the results of tests in the form of two examples of continuous desulphurization of particles of undevolitilized petroleum coke wherein the particle size ranges from about −20 to about +80 mesh, using the process steps and the apparatus as described above. In each example the particles of undevolatilized petroleum coke entering fluidized bed A have an initial sulphur content of about 7% by weight.

EXAMPLE 1

The particles of undevolatilized petroleum coke flowed from a hopper to first heated fluidized bed A at a feed rate of 20 kg/hour and were subjected to the temperature and flow conditions identified in the foregoing discussion. After the coke particles passed through each of heated fluidized beds A, B, and C the output from fluidized bed C was sampled at half-hour time intervals beginning immediately after steady-state conditions had been achieved and the desired temperatures were reached in the respective beds, and the percentage of sulphur by weight in the sampled particles was determined. The results of the sulphur determinations are presented below.

Samples at the outlet of fluidized bed C.

| Time | % Sulfur, by weight |
|---|---|
| 0 hour | 0.89 |
| 0.5 hour | 0.74 |
| 1.0 hours | 0.73 |
| 1.5 hours | 0.68 |
| 2.0 hours | 0.70 |
| 2.5 hours | 0.68 |

At the conclusion of the test, after 2.5 hours had elapsed, the temperature (measured with an optical pyrometer) and the sulphur content of the coke particles in each of the heated fluidized beds were as follows:

| | Temperature, °C. | % Sulphur, by weight |
|---|---|---|
| Bed A | 1500 | 3.93 |
| Bed B | 1650 | 1.63 |
| Bed C | 1950 | 0.68 |

EXAMPLE 2

The same apparatus and process as in Example 1 was repeated except that the feed rate of the particles of undevolatilized petroleum coke to bed A was 10 kg/hour.

Samples at the outlet of bed C.

| Time | % Sulphur, by weight |
|---|---|
| 0.0 hour | 0.64 |
| 0.5 hour | 0.65 |
| 1.0 hour | 0.51 |
| 1.5 hours | 0.53 |
| 2.0 hours | 0.49 |
| 2.5 hours | 0.54 |

At the conclusion of the test, after 2.5 hours had elapsed, the temperature (measured with an optical pyrometer) and the sulphur content of the coke particles in each of the heated fluidized beds were as follows:

| | Temperature, °C. | % Sulphur, by weight |
|---|---|---|
| Bed A | 1550 | 3.65 |
| Bed B | 1700 | 1.47 |
| Bed C | 1980 | 0.54 |

X-ray diffractograms taken of particles of undevolatilized petroleum coke, and of particles of petroleum coke having a sulphur content of 3.65% by weight, of 1.63% by weight, of 0.89% by weight, of 0.51% by weight, and graphite grade electrode, showed that with the decreasing sulphur content, the degree of graphitization of the particles of petroleum coke progressively increased.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A continuous process for the desulphurization of particles of undevolatilized petroleum coke having a particle size of from about −20 to about +80 mesh and having an initial sulphur content of over 5% by weight to obtain a final sulphur level of between about 0.9% and about 0.5% by weight, said process comprising: providing four separate fluidized beds that are interconnected in series by individual inclined conduits to provide a first fluidized bed, a second fluidized bed in communication with said first fluidized bed, a third fluidized bed in communication with said second fluidized bed, and a fourth fluidized bed in communication with said third fluidized bed so that the particles of petroleum coke slide by gravity from one fluidized bed to a successive fluidized bed through a respective inclined conduit, each of said first, second and third fluidized beds having a respective particulate material inlet and a respective vertical wall opposite to and spaced from the particulate material inlet for deflecting entering particles of petroleum coke downwardly before the particles of petroleum coke pass into respective electrical heating zones in each of the first three beds; introducing a fluidized gas upwardly through the bottom of each of said four beds, wherein each of said first, second, and third fluidized beds is a heating bed and includes an electrically operated heating zone and said fourth fluidized bed is a cooling bed; introducing undevolatilized particles of petroleum coke into the inlet of said first fluidized bed; deflecting the particles of petroleum coke downwardly into a preliminary heating zone; heating the particles of undevolitilized petroleum coke in the preliminary heating zone between the particulate material inlet and the vertical wall in said first fluidized bed by thermal conduction to a temperature of about 1000° C. to substantially devolatilize the particles of petroleum coke; passing the substantially devolatilized particles of petroleum coke under a lower edge of said vertical wall of said first fluidized bed into the electrical heating zone of said first fluidized bed; maintaining the temperature of the particles of petroleum coke in said first fluidized bed at between about 1500° C. and about 1600° C. for a period of from about 0.5 hour to about 1 hour to reduce the sulphur content of the particles of petroleum coke from over 5% by weight to between about 3% and about 4% by weight; permitting the particles of petroleum coke to slide by gravity from said first fluidized bed to said second fluidized bed through a connecting inclined conduit; deflecting the particles of petroleum coke downwardly by the vertical wall in said second fluidized bed to cause the particles of petroleum coke to gradually enter the electrical heating zone in said second fluidized bed; maintaining the temperature of the particles of petroleum coke in said second fluidized bed at between about 1650° C. and 1700° C. for a period of from about 0.5 hour and about 1 hour to provide particles of petroleum coke having a sulphur content of from about 1.2% to about 1.8% by weight; permitting the particles of petroleum coke to slide by gravity from said second fluidized bed to said third fluidized bed through a connecting inclined conduit; deflecting the particles of petroleum coke downwardly by the vertical wall in said third fluidized bed to cause the particles of petroleum coke to gradually enter the electrical heating zone in said third fluidized bed; maintaining the temperature of the particles of petroleum coke in said third fluidized bed at between about 1950° C. and about 2200° C. for a period of from about 0.5 hour to about 1 hour to provide particles of petroleum coke having a sulphur content of from about 0.9% to about 0.5% by weight; permitting the particles of petroleum coke to slide by gravity from said third fluidized bed to said fourth fluidized bed through a connecting inclined conduit; cooling the particles of petroleum coke within said fourth fluidized bed by introducing fluidizing gas into said fourth fluidized bed and maintaining the particles in fluidized condition within said fourth fluidized bed for a period of from about 0.25 hour to about 0.5 hour; and thereafter passing the cooled particles of petroleum coke through a conduit for storage.

2. A process for desulphurization of particles of undevolitilized petroleum coke as claimed in claim 1, wherein the fluidizing gas is selected from the group consisting of nitrogen, argon, carbon monoxide, hydrogen and mixtures thereof.

3. A process for desulphurization of particles of undevolitilized petroleum coke as claimed in claim 1, wherein the electrical heating zone in each of said first, second, and third fluidized beds is provided by a pair of spaced graphite electrodes that extend into a respective fluidized bed, and passing an electrical current through the spaced graphite electrodes and through the fluidized particles of petroleum coke between the spaced graphite electrodes within each of the heated fluidized beds to heat the particles of petroleum coke.

* * * * *